US006352355B1

(12) United States Patent
Law

(10) Patent No.: US 6,352,355 B1
(45) Date of Patent: Mar. 5, 2002

(54) DECORATIVE INTERNALLY-LIGHTED AND POSITION-SUSTAINING RIBBON

(75) Inventor: Jeremy Law, Englewood, CO (US)

(73) Assignee: Holiday Creations, Englewood, CO (US)

( * ) Notice: Subject to any disclaimer, the term of this patent is extended or adjusted under 35 U.S.C. 154(b) by 0 days.

(21) Appl. No.: 09/629,008

(22) Filed: Jul. 31, 2000

(51) Int. Cl.[7] ..... F21V 33/00; F21W 121/00
(52) U.S. Cl. ..... 362/253; 362/234; 362/806
(58) Field of Search ..... 362/108, 253, 362/227, 249, 250, 252, 806, 234

(56) References Cited

U.S. PATENT DOCUMENTS

| | | | | |
|---|---|---|---|---|
| 3,153,745 A | | 10/1964 | Gurian et al. | |
| 3,641,333 A | * | 2/1972 | Gendron | 362/108 |
| 4,234,907 A | | 11/1980 | Daniel | 362/32 |
| 4,271,458 A | | 6/1981 | George, Jr. | 362/249 |
| 4,480,293 A | | 10/1984 | Wells | 362/108 |
| 4,599,682 A | | 7/1986 | Stephens | 362/103 |
| 4,607,317 A | | 8/1986 | Lin | 362/249 |
| 4,761,720 A | | 8/1988 | Solow | 362/252 |
| 4,774,642 A | | 9/1988 | Janko et al. | 362/108 |
| 4,839,777 A | | 6/1989 | Janko et al. | 362/108 |
| 4,875,144 A | | 10/1989 | Wainwright | 362/103 |
| 4,885,664 A | | 12/1989 | Hermanson | 362/249 X |
| 4,901,661 A | | 2/1990 | Sturm et al. | 112/436 |
| 4,924,362 A | | 5/1990 | Janko et al. | 362/108 |
| 4,981,095 A | | 1/1991 | Sturm et al. | 112/436 |
| 5,057,981 A | | 10/1991 | Bowen et al. | 362/219 |
| 5,073,844 A | | 12/1991 | Coyner et al. | 362/156 |
| 5,074,251 A | * | 12/1991 | Pennock | 362/108 X |
| 5,080,029 A | | 1/1992 | Salomon et al. | 112/139 |
| 5,128,843 A | | 7/1992 | Guritz | 362/103 |
| 5,371,657 A | | 12/1994 | Wiscombe | 362/103 |
| 5,410,459 A | * | 4/1995 | Yang | 362/252 X |
| 5,438,804 A | * | 8/1995 | Reum et al. | 362/249 X |
| 5,477,437 A | | 12/1995 | Lach | 362/252 |
| 5,566,483 A | | 10/1996 | Ogren | 40/564 |
| 5,746,500 A | | 5/1998 | Chien | 362/103 |
| 5,779,348 A | | 7/1998 | Interlicchio | 362/108 |
| 5,879,076 A | | 3/1999 | Cross | 362/555 |
| 5,934,792 A | * | 8/1999 | Camarota | 362/249 |
| 5,975,718 A | | 11/1999 | White | 362/252 |
| 6,015,218 A | | 1/2000 | Snell | 362/249 |
| 6,039,458 A | | 3/2000 | Coates, Jr. et al. | 362/250 X |
| RE36,636 E | | 4/2000 | Sturm et al. | 112/436 |

* cited by examiner

*Primary Examiner*—Laura K. Tso
(74) *Attorney, Agent, or Firm*—John R. Ley

(57) ABSTRACT

A decorative, internally-lighted ribbon is formed by a light string and two elongated strips of flexible, semi-translucent material which are connected to form a hollow, elongated sleeve-like enclosure within which a light string is positioned to extend substantially along the length of the enclosure. The semi-translucent material of the strips transfers light from the light string through the strips to create an exterior visual appearance of internal lighting along the length of the ribbon. An internal structure, such as a wire, holds the strips in a flat ribbon-like configuration and allows the ribbon to be bent into decorative shapes. The strips are preferably fire-retardant.

40 Claims, 4 Drawing Sheets

DECORATIVE INTERNALLY-LIGHTED AND POSITION-SUSTAINING RIBBON

FIELD OF THE INVENTION

This invention relates to holiday and festive ornamentation. More particularly, the present invention relates to a new and improved decorative ribbon with internal lighting to create an external distinctive muted and diffused appearance along its length, and which permits formation of the ribbon into a desired position and shape.

BACKGROUND OF THE INVENTION

Decorative ribbons are used for ornamentation, particularly during holiday and festive celebrations. Decorative ribbons are used on Christmas trees, wreaths, and mantles, among other ornamented items. The ribbons promote a festive atmosphere and highlight, complement, or emphasize the item to which they are connected. Often, the ribbons are formed into decorative shapes, such as bows, before attaching or placing them onto the ornamented item.

It is typical to rely on an external light source to provide illumination and visual emphasis to the decorative ribbon. The light source may consist of a single direct lamp located a distance away from the ribbon, such as an ordinary room or spotlight, or multiple light sources in close proximity to the ribbon, such as a string of conventional Christmas lights.

The illumination of the ribbon with a single direct light source often results in a shiny or bright appearance of the ribbon at various light reflection points on the ribbon. In addition, portions of the ribbon that are not directly exposed to the single direct light source appear darker than other portions of the ribbon. The lighter and darker portions of the ribbon create a non-uniform appearance to the illuminated ribbon. When the ribbon extends to the side or around the ornamented item upon which it is connected, the light from a single source will often not highlight the entire ribbon. The single direct light source also illuminates other objects or areas near the ribbon, which detracts from the visual emphasis of the ribbon.

When multiple light sources in a string are attached to the ornamented item near the ribbon or directly to the ribbon itself, the visual lighted emphasis of the ribbon may be increased, but the close proximity of the exterior lights also result in a non-uniform appearance of the ribbon. Sometimes, the exterior lights can be so distinctive and intense that they overwhelm the visual impact of the decorative ribbon. In addition, some light sources may pose a fire danger if they come into contact with the ribbon. Furthermore, time and effort is required to position the light strings in relation to the ribbon to achieve the desired visual emphasis and prevent a fire danger.

Conventional decorative ribbons lack rigidity of physical form. A conventional decorative ribbon will usually not hold its shape after the ribbon has been formed into a desired position or shape. The position and shape of a conventional decorative ribbon are often held by use of additional attachment and retention devices such as clips and wires to fasten the ribbon onto its underlying ornamented item and to maintain the shape of the ribbon. The use of the separate attachment and retention devices adds complexity and inconvenience to the process of positioning the ribbon on an ornamented item or forming a decorative structure, such as a bow, from the ribbon.

It is with respect to these and other considerations that have given rise to the present invention.

SUMMARY OF THE INVENTION

One aspect of the present invention relates to a decorative lighted ribbon with internal lights for illuminating the ribbon. The internal illumination of the ribbon provides an external uniform, muted and diffused visual appearance along the entire length of the ribbon. The internal illumination of the ribbon also provides visual emphasis of the ribbon in relation to surrounding ornamented items. Another aspect of the invention relates to a decorative lighted ribbon made of a fire-retardant fabric material. The fire-retardant fabric material reduces the fire danger from the heat from the internal lights in close proximity or contact with the ribbon.

Another aspect of the present invention relates to a decorative lighted ribbon with an internal structure for holding the position and shape of the ribbon. The internal structure, such as a malleable wire along the edges of the ribbon, holds the ribbon into a position or shape into which it is formed without the need of external devices, such as fasteners or retainers. The ribbon becomes self-supporting and position-retaining to hold its position and shape until later changed. The malleable wire internal structure also maintains the ribbon in a flat, sheet-like appearance and shape, even with the internal lights within the ribbon. Moreover, the malleable wire internal structure allows the ribbon to be formed into a variety of decorative shapes, such as bows, and does not interfere with the light string within the ribbon.

Another aspect of the present invention relates to a decorative lighted ribbon with electrical connectors at each end of the internal light string which extends internally and through the length of the ribbon. Two or more decorative lighted ribbons can be connected together in an end-to-end fashion using these electrical connectors. One long continuous internally lighted ribbon may be made from a number of the connected shorter ribbons, thus increasing the opportunities for festive decorating.

In accordance with these and other aspects of the invention, the decorative, internally-lighted ribbon comprises a light string, and two elongated strips of flexible, semi-translucent material. The strips are connected along their longitudinally-extending and transversely spaced apart edges to form a hollow, elongated sleeve-like enclosure. A light string extends substantially along the length of and within the sleeve-like enclosure. The semi-translucent material of the strips transfers light from the light string through the strips to create an exterior visual appearance of internal lighting along the length of the connected strips. An alternative of the decorative, internally-lighted ribbon is intended for use with a light string and comprises two elongated strips of flexible, semi-translucent material connected along their longitudinally-extending and transversely spaced apart edges to form a hollow, elongated sleeve-like enclosure. An opening structure at each end of the elongated sleeve-like enclosure receives the light string. A structural element extends along the strips to hold the sleeve-like enclosure in a generally flat ribbon-like configuration upon insertion of the light string into the sleeve-like enclosure. The semi-translucent material of the strips have characteristics which allow the light from the interior of the sleeve-like structure to propagate through the sleeve-like enclosure and create an exterior visual appearance of internal lighting along the length of the connected strips.

Other preferred aspects of the decorative, internally-lighted ribbon include a wire extending along the length of the strips to hold the strips in position. The wire preferably has malleable characteristics allowing the strips to be bent without breaking. The wire preferably extends along each longitudinally-extending and transversely spaced edge of the strip to maintain the strips in a generally flat configuration of the ribbon and inhibit the connected strips from assuming a generally tubular shape. An enclosure for each wire is formed by joining the strips of material on opposite sides of the wire, such as by a seam of threads stitched through the strips of material on opposite sides of the wire. The strips also preferably have fire-retardant characteristics to resist flammability from heat generated by the light string. The strips may be formed of a fabric material woven from metallic threads or chemically treated with a fire retardant substance. The metallic threads may reflect light through a plurality of interstices resulting from weaving the fabric of the strips from threads, some of which are metallic. The light string preferably includes electrical connectors at opposite ends which extend from a sleeve-like enclosure of the ribbon. The electrical connectors connect other light strings and sleeve-like enclosures in a continuous end-to-end relationship. The flexibility of the lighted ribbon permits it to be formed into decorative shapes, such as a bow.

Another aspect of the invention relates to a method of internally lighting and decorating a ribbon comprising the steps of connecting two elongated strips of flexible, semi-translucent material along their longitudinally-extending and transversely spaced-apart edges to form a hollow, elongated sleeve-like enclosure having open ends at opposite ends of the sleeve-like enclosure; inserting a light string into one of the open ends, through the sleeve-like structure, and out the other open end; and energizing the light string to transfer light from the light string through the strips to create an exterior appearance of internal lighting along the length of the connected strips. A further aspect of the invention relates to a method of constructing an internally-lighted ribbon for use with a light string comprising the steps of connecting two elongated strips of flexible, semi-translucent material along their longitudinally-extending and transversely spaced-apart edges to form a hollow, elongated sleeve-like enclosure having a size capable of receiving a light string within the interior of the sleeve-like enclosure, extending a structural element along the elongated sleeve-like enclosure to hold the sleeve-like enclosure in a generally flat ribbon-like configuration upon the insertion of a light string within the interior of the sleeve-like structure, and selecting strips having characteristics allowing the transfer of light from the interior of the sleeve-like structure through the strips to create an exterior visual appearance of internal lighting along the length of the connected strips.

A more complete appreciation of the present invention and its improvements can be obtained by reference to the accompanying drawings, which are briefly summarized below, by reference to the following detailed description of a presently preferred embodiment of the invention, and by reference to the appended claims.

DETAILED DESCRIPTION

Figure 1:
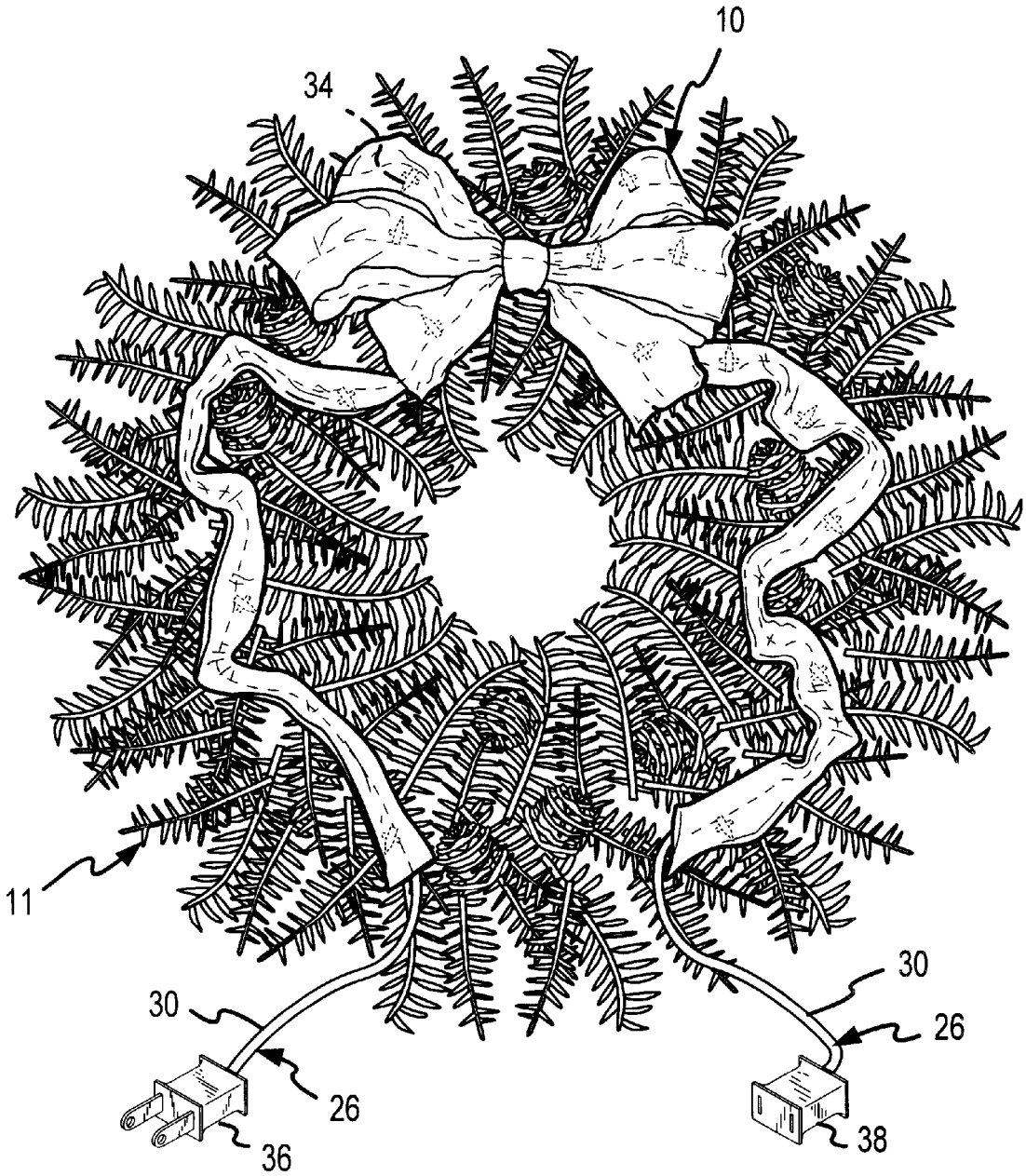
FIG. 1 is a perspective view of a wreath upon which a decorative lighted ribbon incorporating the present invention has been attached.
Figure 2:
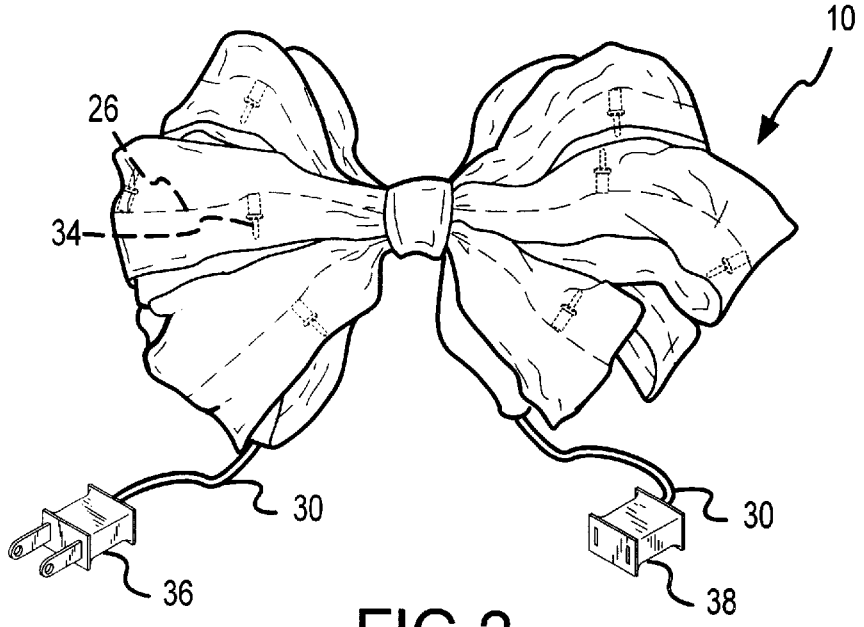
FIG. 2 is a perspective view of a bow which has been formed from a decorative lighted ribbon incorporating the present invention, showing internal components in phantom.

The present invention is incorporated into a decorative lighted ribbon 10 shown in FIG. 1. The decorative lighted ribbon 10 can be attached to an ornamented item such as a wreath 11 as shown in FIG. 1. The decorative lighted ribbon 10 can be made into a decorative configuration itself, such as a bow as shown in FIG. 2, as well as be used with many other ornamental and festive applications. For example, the lighted ribbon 10 can also be attached to a Christmas tree (not shown), strung as ornamentation on a mantle (not shown), fashioned into or otherwise incorporated with garland (not shown), or otherwise used in a general decorative sense.

Figure 3:
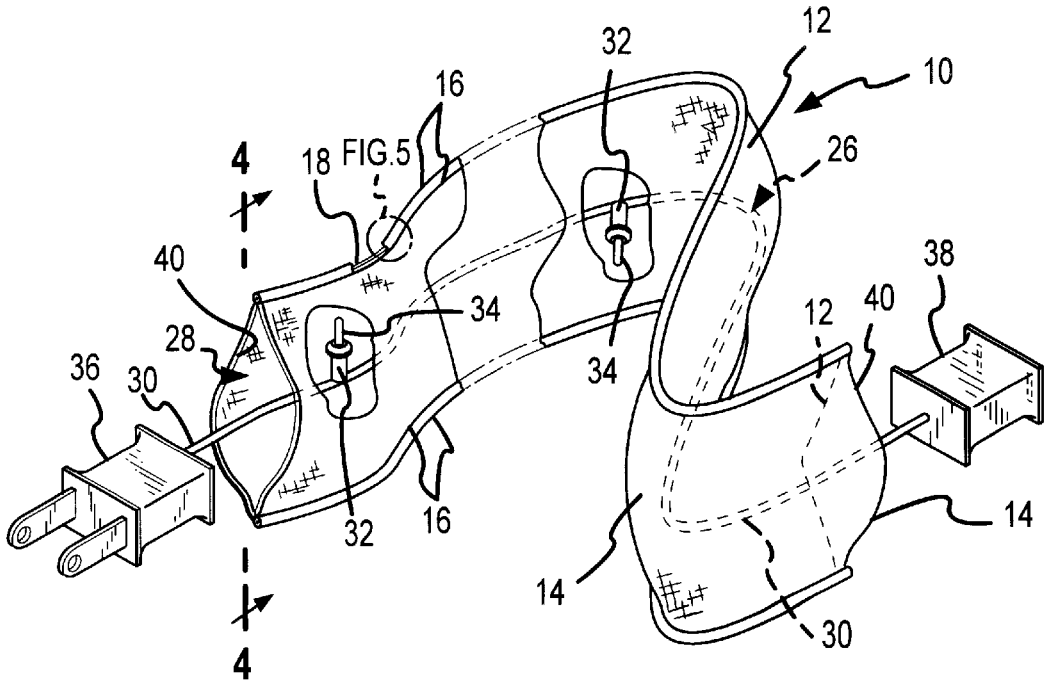
FIG. 3 is an enlarged partial perspective view of a portion of the decorative lighted ribbon shown in FIGS. 1 and 2, with portions broken out for clarity.
Figure 4:
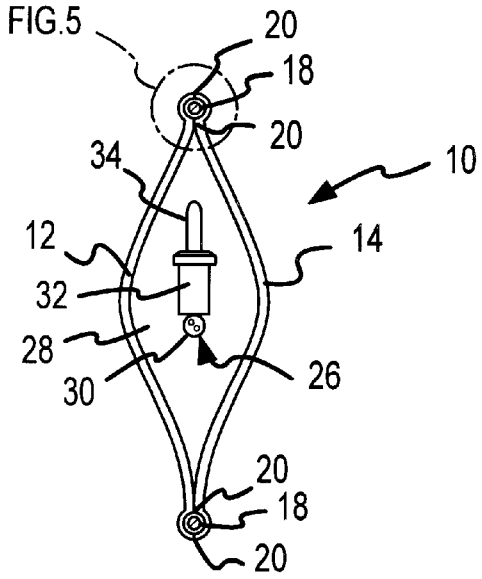
FIG. 4 is an enlarged cross-sectional view taken substantially in the plane of line 4—4 of FIG. 3.
Figure 5:
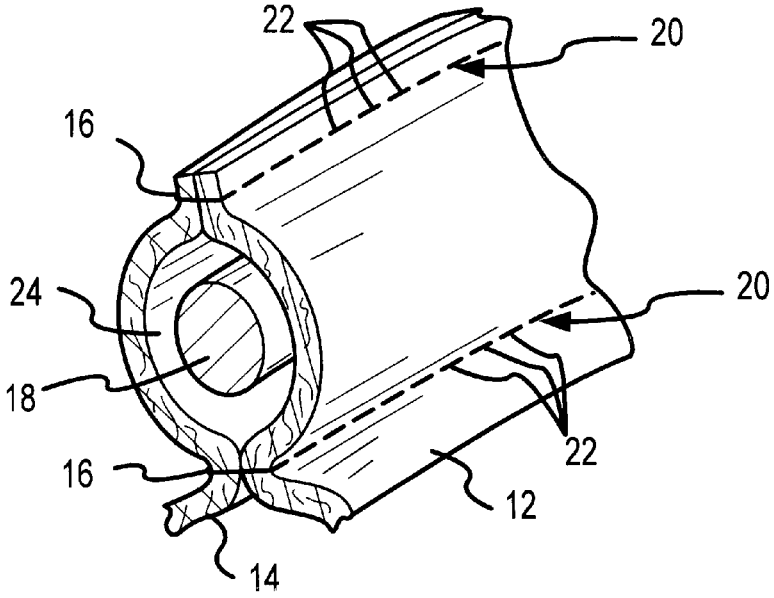
FIG. 5 is an enlarged partial perspective view of a malleable wire and its connection along one edge of the ribbon as shown in FIGS. 3 and 4.

The decorative lighted ribbon 10 is formed by two elongated strips 12 and 14 of flexible, semi-translucent material, such as fire retardant fabric, which are attached together along their longitudinal edges on transversely opposite sides of each of the strips 12 and 14, as shown in FIGS. 3 and 4. Also attached along the longitudinal edges of the strips 12 and 14, preferably by sewing thread 16, is a malleable wire 18, as is also shown in FIG. 5. A seam 20 is formed by stitches 22 is of the thread 16 along each side of the wire 18 at the edges of the strips 12 and 14. The edge portions of the strips 12 and 14 between the seems 20 form a wire enclosure 24 which surrounds the wire 18 and encloses it. The wire enclosure 24 also maintains the wires 18 in position along the edges of the strips 12 and 14.

The bendable (malleable) wires 18 hold the decorative lighted ribbon 10 into a desired position shaped by the user, until this position is later changed by the user bending the ribbon 10 and the wires 18 into a different position. The malleability of the wires 18 allows the ribbon 10 to be bent in a variety of different shapes to satisfy the decorator. The malleability of the wire permits repeated bending of the wires 18 without fatiguing the wire and causing it to break. Once in the desired position, the wires 18 hold or retain the ribbon 10 without the necessity for external clips or other holding were retaining devices. Of course, depending on the use of the ribbon 10, it may be necessary to attach the ribbon to the wreath or Christmas tree, for example, by the use of an external attachment device.

A light string 26 is inserted within a hollow, generally elongated sleeve-like enclosure 28 formed as a result of connecting the flexible strips 12 and 14 along their longitudinally-extending and transversely-spaced edges, as shown in FIGS. 3 and 4. The hollow sleeve-like enclosure 28 receives and contains the light string 26, such as a conventional miniature Christmas tree light string. The light string 26 may be inserted in the sleeve-like enclosure 28 during the manufacture of the decorative lighted ribbon 10 after the wire 18 has been captured in the wire enclosure 24 formed by stitching the seems 20. Alternatively, the decorative lighted ribbon 10 can be manufactured as described herein without the interior light string 26, and the user can later insert a conventional miniature Christmas tree light string in the sleeve-like enclosure 28 prior to use of the decorative lighted ribbon.

Locating the malleable wire 18 in the wire enclosure 24 (FIG. 5) along each longitudinally-extending and transversely-spaced edge of the strips 12 and 14 causes the strips 12 and 14 to remain generally flat and separated from one another as shown in FIG. 4. The ribbon 10 remains relatively flat even though the light string 26 has been inserted into the sleeve-like enclosure 28. The flat external appearance to the strips 12 and 14 presents the visual appearance of a ribbon. Without the malleable wires 18 along the opposite edges, the strips 12 and 14 might tend to expand into a generally tubular configuration, which would not convey the image of a ribbon. Enclosing the malleable wire 18 in the enclosure 24 (FIG. 5) also separates and insulates the wires 18 from the electrically conductive light string 26, thereby preventing the wire 18 from contacting the light string and possibly becoming electrically conductive as a result of such inadvertent contact.

Figure 6:
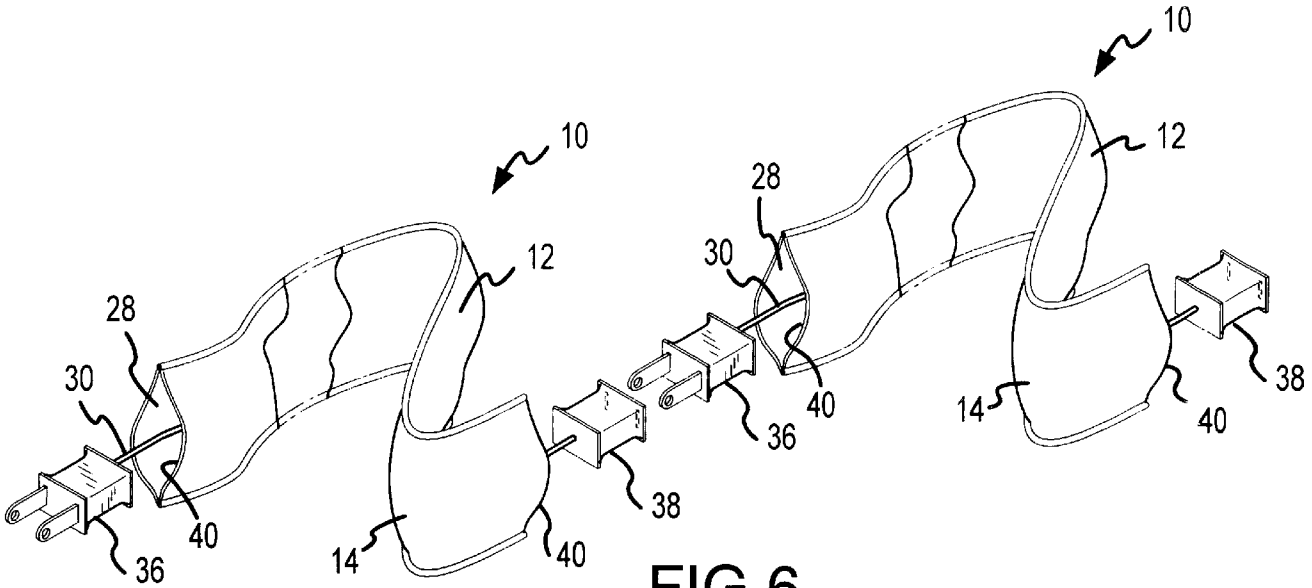
FIG. 6 is a partial perspective view of two decorative lighted ribbons, each incorporating the present invention, and shown not connected to each other.
Figure 7:
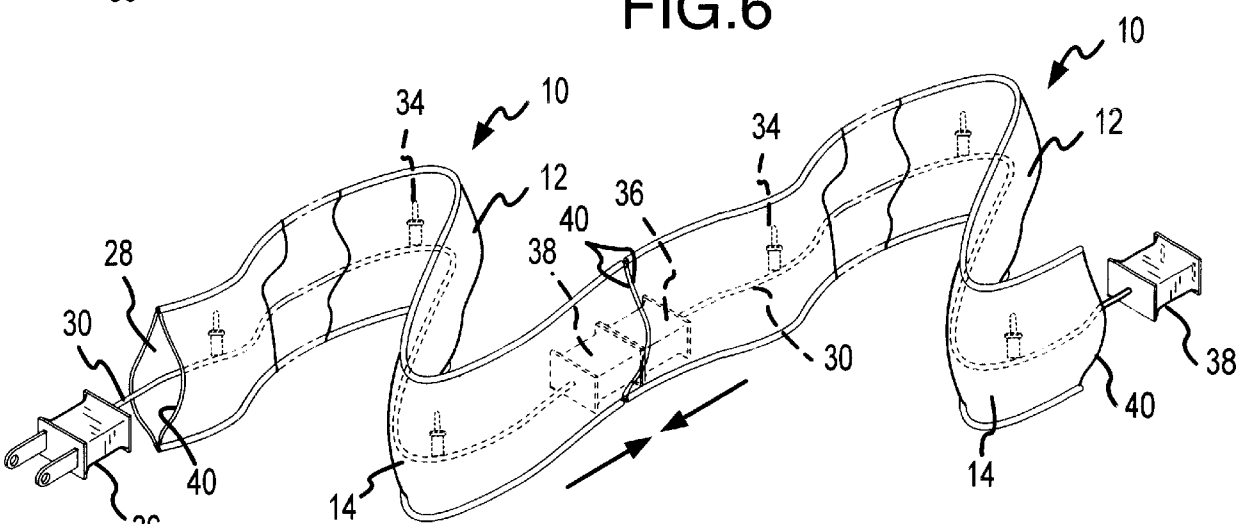
FIG. 7 is a partial perspective view of two decorative lighted ribbons similar to those shown in FIG. 6, each incorporating the present invention, and shown connected to each other to form a continuous end-to-end extension of the two ribbons.

The light string 26 is preferably a conventional miniature Christmas tree light string which includes a pair of electrical conductors formed at the ends of the cord 30 as shown in FIG. 3. The electrical conductors of the cord 30 conduct electricity to lamp sockets 32 which are located at spaced apart positions along the length of the cord 30, as also shown in FIG. 4. Lamp bulbs 34 are inserted in the sockets 32. A conventional male electrical plug connector 36 is connected to one end of the cord 30, and a conventional female electrical plug connector 38 is connected at the other end of the cord 30, as shown in FIGS. 6 and 7. Electrical current is delivered from the connectors 36 and 38 along the conductors of the cord 30 to the lamp bulbs 34. When energized, the lamp bulbs 34 emit light.

The light from the lamp bulbs 34 is projected through the semi-translucent material of the strips 12 and 14 to the outside for observation. The semi-translucent light-transmissive characteristic of the material of the strips 12 and 14 creates a pleasing, internally muted but nevertheless distinctive external visual lighting effect along the entire length of the ribbon 10. The internally muted effect from the semi-translucent material of the strips 12 and 14 creates a distinctively different visual impression compared to the visual effect resulting from externally lighting an ordinary decorative ribbon. The projection of the light from within the decorative light ribbon 10 causes a uniform, muted and diffused areas of visual emphasis along the entire length of the ribbon.

The length of the cord 30 between the electrical connectors 36 and 38 is sufficient to extend the light string 26 along the entire length of the sleeve-like enclosure 28 formed by the strips 12 and 14 as shown in FIG. 6. The electrical connectors 36 and 38 are located, or are available, at open opposite ends 40 of the sleeve-like enclosure 28. Consequently, it is possible to connect multiple decorative lighted ribbons 10 in a serial, end-to-end fashion, as shown in FIG. 7. The connection together of multiple decorative lighted ribbons 10 in a serial fashion allows the user to create a very lengthy continuous decorative lighted ribbon. The ability to create relatively long decorative lighted ribbons is very useful for decorating Christmas trees, mantles, stair banisters and the like where the user desires a long continuous decorative lighted ribbon effect.

Each strip 12 and 14 is preferably made of a fire-retardant fabric material. The fire-retardant fabric material reduces the risk of fire resulting from the heat generated by the lamp bulbs 34. As understood from FIG. 4, the lamp bulbs 34 may be located in contact with the strips 12 and 14 when positioned inside the sleeve-like enclosure 28. This physical contact increases the transfer of heat energy from the lamp bulbs 34 to the material of the strips 12 and 14. Depending upon the degree of heat transfer from the lamp bulbs 34 and the size of the lamp bulbs, sufficient heat could ignite the fabric of material which is not fire-retardant.

The fire-retardant characteristics of the strips 12 and 14 may be obtained in a conventional manner, such as by chemical treatment of the fabric material. The inclusion of metallic threads within a woven fabric material of the strips 12 and 14 also has a fire-retardant effect, because the metal threads are not combustible. An additional advantage of metallic threads woven into the fabric of the strips 12 and 14 is a light reflective capability of metallic thread. Small interstices of open space exist between each of the threads which cross each other in the woven configuration of the material of the strips 12 and 14, and the small interstices allow the light to project through the material to create the semi-translucent characteristic. Metallic threads assist in reflecting this light internally within the hollow sleeve-like enclosure 28. When viewed externally, the reflective metallic threads contribute to the muted diffuse visual external appearance available from this semi-translucent woven material. The fire-retardant fabric characteristic preferably meets consumer testing and safety requirements for this type of product.

Incorporating of the light string 26 between the two strips 12 and 14 causes the decorative lighted ribbon 10 to present a pleasing, uniform, muted and diffused appearance with periodically spaced areas of enhanced visual emphasis at the location of the lamp bulbs 34 along the length of the light string 26. The malleable wire 18 of the decorative lighted ribbon 10 allows for formation of the ribbon 10 into a self-sustaining position, such as a bow or in a desired configuration, until reformation of the shaped is desired. Moreover, the malleable wire 18 which extends along the longitudinal edges of the ribbon 10 is sufficient to maintain the strips 12 and 14 in a generally flat configuration resembling a ribbon. The decorative lighted ribbon 10 allows similar ribbons to be connected serially in an end-to-end fashion to achieve a relatively long singular decorative lighted ribbon. Many other advantages and improvements will be apparent after gaining an understanding of the present invention.

A presently preferred embodiment of the invention have been shown and described with a degree of particularity. This description is of a preferred example of the invention. In distinction to its preferred example, it should be understood that the scope of the present invention is defined by the scope of the following claims, which should not necessarily be limited to the detailed description of the preferred embodiment set forth above.

The invention claimed is:

1. A decorative internally-lighted ribbon, comprising:

a light string; and a hollow, elongated sleeve-like enclosure comprising at least one elongated strip of flexible, semi-translucent material;

the light string extending substantially along the length of and within the sleeve-like enclosure, the semi-translucent material of the strip transferring light from the light string through the strip to create an exterior visual appearance of internal lighting along the length of the strip.

2. A decorative internally-lighted ribbon as defined in claim 1 formed into a decorative shape other than an elongated shape.

3. A decorative internally-lighted ribbon as defined in claim 2 wherein the decorative shape is a bow.

4. A decorative internally-lighted ribbon as defined in claim 1 wherein:

the light string comprises miniature Christmas lights.

5. A decorative internally-lighted ribbon as defined in claim 1 wherein:

the sleeve-like enclosure comprises two elongated strips of flexible, semi-translucent material connected along their longitudinally-extending and transversely spaced apart edges.

6. A decorative internally-lighted ribbon, comprising:

a light string;

a hollow, elongated sleeve-like enclosure comprising at least one elongated strip of flexible, semi-translucent material; and a wire extending along the length of the strip to hold the strip in position;

the light string extending substantially along the length of and within the sleeve-like enclosure, the semi-translucent material of the strip transferring light from the light string through the strip to create an exterior visual appearance of internal lighting along the length of the strip.

7. A decorative internally-lighted ribbon as defined in claim 6 wherein:

the wire includes malleable characteristics to allow the strip to be bent into multiple positions.

8. A decorative internally-lighted ribbon as defined in claim 6 wherein:

the strip includes a pair of longitudinally-extending and transversely spaced apart edges; and a wire extends along each longitudinally-extending and transversely spaced apart edge of the strip.

9. A decorative internally-lighted ribbon as defined in claim 8 wherein:

the wires maintain the transversely opposite longitudinal edges of the strip in a generally flat configuration of the ribbon and inhibit the sleeve-like enclosure from assuming a generally tubular shape.

10. A decorative internally-lighted ribbon as defined in claim 9 wherein:

the wire includes malleable characteristics to allow the strip to be bent into multiple positions while maintaining the generally flat configuration and inhibiting the assumption of a generally tubular shape.

11. A decorative internally-lighted ribbon as defined in claim 8 wherein:

the strip extends continuously along the length of the hollow sleeve-like enclosure between open ends of the sleeve-like enclosure; and the wires at the edges of the strip extend continuously along the length of the strip between open ends of the hollow sleeve-like enclosure.

12. A decorative internally-lighted ribbon as defined in claim 8 wherein:

each wire is located in an enclosure extending along a longitudinal edge of the strip; and the enclosure for each wire is formed by a portion of the strip on one side of the wire.

13. A decorative internally-lighted ribbon as defined in claim 12 wherein:

the enclosure for each wire is formed by a seam of threads stitched through the strip on one side of the wire.

14. A decorative internally-lighted ribbon as defined in claim 12 wherein:

the enclosure for each wire separates and insulates each wire from the light string.

15. A decorative internally-lighted ribbon as defined in claim 8 wherein:

each wire includes malleable characteristics to allow the strip to be bent into multiple positions.

16. A decorative internally-lighted ribbon as defined in claim 6 further comprising:

an enclosure for the wire which separates and insulates the wire from the light string.

17. A decorative internally-lighted ribbon, comprising:

a light string; and a hollow, elongated sleeve-like enclosure comprising at least one elongated strip of flexible, semi-translucent material;

the light string extending substantially along the length of and within the sleeve-like enclosure, the semi-translucent material of the strip transferring light from the light string through the strip to create an exterior visual appearance of internal lighting along the length of the strip, and the strip includes a plurality of interstices distributed along its length through which light from the light string passes.

18. A decorative internally-lighted ribbon as defined in claim 17 wherein:

the strip is formed of a fabric material woven from threads;

the interstices result from the intersection of the threads of woven material; and at least some of the threads of the woven material are metallic.

19. A decorative internally-lighted ribbon, comprising:

a light string; and a hollow, elongated sleeve-like enclosure comprising at least one elongated strip of flexible, semi-translucent material; and wherein:

the light string extends substantially along the length of and within the sleeve-like enclosure;

the semi-translucent material of the strip transferring light from the light string through the strip to create an exterior visual appearance of internal lighting along the length of the strip;

the light string further includes electrical connectors at opposite ends by which to conduct electrical current to the light string;

the sleeve-like enclosure includes open ends at opposite ends of the elongated strip; and the electrical connectors are located adjacent to the open ends of the sleeve-like enclosure.

20. A decorative internally-lighted ribbon as defined in claim 19 further comprising:

plurality of sleeve-like enclosures, each sleeve-like enclosure including a strip of material;

a plurality of the light strings, one light string located in each sleeve-like enclosure; and wherein:

the electrical connectors at each end of each light string are located adjacent to the open ends of each sleeve-like enclosure;

the electrical connector of one light string is connected to the electrical connector of another light string; and the open ends of the sleeve-like enclosures are adjacent to one another at the locations of the connected electrical connectors of the plurality of light strings.

21. A decorative internally-lighted ribbon for use with a light string, comprising:

a hollow, elongated sleeve-like enclosure comprising at least one elongated strip of flexible, semi-translucent material connected as part of the sleeve-like enclosure along its longitudinally-extending and transversely spaced apart edges;

open ends at opposite ends of the elongated sleeve-like enclosure for receiving the light string into the sleeve-like enclosure; and a structural element extending along the strip to hold the sleeve-like enclosure in a generally flat ribbon-like configuration upon insertion of the light string into the sleeve-like enclosure;

the semi-translucent material of the strip having characteristics allowing the transfer of light from the interior of the sleeve-like structure through the strips to create an exterior visual appearance of internal lighting along the length of the connected strips.

22. A decorative internally-lighted ribbon as defined in claim 21 wherein:

the sleeve-like enclosure is formed by two strips of material connected along their longitudinally-extending and transversely spaced apart edges.

23. A method of internally lighting and decorating a ribbon comprising:

connecting an elongated strip of flexible, semi-translucent material along its longitudinally-extending and transversely spaced-apart edges to form a part of a hollow, elongated sleeve-like enclosure having open ends at opposite ends of the sleeve-like enclosure;

inserting a light string into one of the open ends;

extending the light string through the sleeve-like enclosure substantially from one open end to the other open end; and energizing the light string to transfer light from the light string through the strip to create an exterior visual appearance of internal lighting along the length of the strip.

24. A method as defined in claim 23 comprising:

connecting two of the elongated strips of flexible, semi-translucent material along their longitudinally-extending and transversely spaced-apart edges to form the hollow, elongated sleeve-like enclosure.

25. A method of constructing an internally-lighted ribbon for use with a light string comprising:

connecting two elongated strips of material along their longitudinally-extending and transversely spaced-apart edges to form a hollow, elongated sleeve-like enclosure having a size capable of receiving a light string within the interior of the sleeve-like enclosure;

extending a structural element along the elongated sleeve-like enclosure to hold the sleeve-like enclosure in a generally flat ribbon-like configuration upon the insertion of a light string within the interior of the sleeve-like structure; and selecting flexible, semi-translucent material for at least one of the two connected strips forming the sleeve-like enclosure to transfer light from the interior of the sleeve-like structure through that one strip to create an exterior visual appearance of internal lighting along the length of that one strip.

26. A method as defined in claim 25 comprising:

selecting flexible, semi-translucent material for the two connected strips forming the sleeve-like enclosure.

27. A decorative internally-lighted ribbon, comprising:

a light string;

a hollow, elongated sleeve-like enclosure comprising two elongated strips of flexible, semi-translucent material connected along their longitudinally-extending and transversely spaced apart edges; and a wire extending along the length of the strips to hold the strips in position;

the light string extending substantially along the length of and within the sleeve-like enclosure, the semi-translucent material of the strip transferring light from the light string through the strip to create an exterior visual appearance of internal lighting along the length of the strip.

28. A decorative internally-lighted ribbon as defined in claim 27 wherein:

the two connected strips substantially form the sleeve-like enclosure.

29. A decorative internally-lighted ribbon as defined in claim 27 wherein:

each wire is located in an enclosure extending along the longitudinal edges of the strips; and the enclosure for each wire is formed by joining the strips on opposite sides of the wire.

30. A decorative internally-lighted ribbon as defined in claim 29 wherein:

the wires maintain the transversely opposite longitudinal edges of the sleeve-like enclosure in a generally flat configuration of the ribbon and inhibit the strip from assuming a generally tubular shape.

31. A decorative internally-lighted ribbon as defined in claim 30 wherein:

the wire includes malleable characteristics to allow the sleeve-like enclosure to be bent into multiple positions while maintaining the generally flat configuration and inhibiting the assumption of a generally tubular shape.

32. A decorative internally-lighted ribbon as defined in claim 30 wherein:

the strip extends continuously along the length of the hollow sleeve-like enclosure between open ends of the sleeve-like enclosure; and the wires at the edges of the strips extend continuously along the length of the strips between open ends of the hollow sleeve-like enclosure.

33. A decorative internally-lighted ribbon as defined in claim 30 wherein:

the enclosure for each wire is formed by seams of threads stitched through the strips on opposite sides of the wire.

34. A decorative internally-lighted ribbon as defined in claim 30 wherein:

the enclosure for each wire separates and insulates each wire from the light string.

35. A decorative internally-lighted ribbon as defined in claim 30 wherein:

the light string further includes electrical connectors at opposite ends by which to conduct electrical current to the light string;

the sleeve-like enclosure includes open ends at opposite ends of the elongated strip; and the electrical connectors are located adjacent to the open ends of the sleeve-like enclosure.

36. A decorative internally-lighted ribbon, comprising:

a light string; and a hollow, elongated sleeve-like enclosure comprising at least one elongated strip of flexible, semi-translucent fabric material;

the light string extending substantially along the length of and within the sleeve-like enclosure, the fabric material of the strip transfers light from the light string through the strip to create an exterior visual appearance of internal lighting along the length of the strip.

37. A decorative internally-lighted ribbon as defined in claim 36 wherein:

the fabric material is woven from threads; and at least some of the threads from which the fabric material is woven are metallic.

38. A decorative internally-lighted ribbon as defined in claim 36 wherein:

the fabric material has fire retardant characteristics which result at least in part from the metallic threads.

39. A decorative internally-lighted ribbon as defined in claim 36 wherein:

the fabric material has fire-retardant characteristics to resist flammability from heat generated by the light string.

40. A decorative internally-lighted ribbon as defined in claim 36 wherein:

the fabric material is chemically treated with a fire retardant substance.

* * * * *